US008132420B2

(12) United States Patent
Okoren et al.

(10) Patent No.: US 8,132,420 B2
(45) Date of Patent: Mar. 13, 2012

(54) VARIABLE EVAPORATOR WATER FLOW COMPENSATION FOR LEAVING WATER TEMPERATURE CONTROL

(75) Inventors: Ronald W. Okoren, Holmen, WI (US); Joel C. VanderZee, La Crosse, WI (US)

(73) Assignee: Trane International Inc., Piscataway, NJ (US)

( * ) Notice: Subject to any disclaimer, the term of this patent is extended or adjusted under 35 U.S.C. 154(b) by 744 days.

(21) Appl. No.: 12/291,244

(22) Filed: Nov. 7, 2008

(65) Prior Publication Data

US 2010/0121495 A1 May 13, 2010

(51) Int. Cl.
*F25D 17/00* (2006.01)

(52) U.S. Cl. ..... 62/180; 62/238.3; 62/476

(58) Field of Classification Search ..... 62/112, 62/141, 180, 238.3, 292, 476
See application file for complete search history.

(56) References Cited

U.S. PATENT DOCUMENTS

| | | | | |
|---|---|---|---|---|
| 4,715,190 | A | 12/1987 | Han et al. | |
| 4,905,479 | A * | 3/1990 | Wilkinson | 62/271 |
| 5,553,997 | A | 9/1996 | Goshaw et al. | |
| 5,611,216 | A * | 3/1997 | Low et al. | 62/612 |
| 5,809,794 | A | 9/1998 | Sibik et al. | |
| 6,050,098 | A | 4/2000 | Meyer et al. | |
| 6,357,240 | B1 * | 3/2002 | Zugibe et al. | 62/85 |

* cited by examiner

*Primary Examiner* — Melvin Jones
(74) *Attorney, Agent, or Firm* — William O'Driscoll

(57) ABSTRACT

A method of controlling a refrigerant chiller system is particularly suited for chillers where the water being chilled (or some other liquid) flows through the chiller's evaporator at a flow rate that is variable and is not directly known. To effectively control the chiller and maintain the temperature of the water leaving the evaporator at a desired target temperature, the cooling capacity of the chiller's evaporator is estimated based the degree of valve opening of an expansion valve, a pressure differential across the expansion valve, and a change in enthalpy per unit mass of the refrigerant flowing through the evaporator. In some embodiments, the chiller system includes multiple refrigerant circuits that are hermetically isolated from each other.

20 Claims, 2 Drawing Sheets

VARIABLE EVAPORATOR WATER FLOW COMPENSATION FOR LEAVING WATER TEMPERATURE CONTROL

FIELD OF THE INVENTION

The subject invention generally pertains to the control of an HVAC chiller that includes an evaporator and more specifically to a method of controlling the evaporator's cooling capacity to achieve a desired temperature of the chilled water leaving the evaporator, wherein the water flow rate through the evaporator varies.

BACKGROUND OF RELATED ART

Typical refrigerant chillers basically comprise a compressor, condenser, expansion device and an evaporator. Within the evaporator, vaporizing refrigerant cools a supply of water that is then circulated through a network of heat exchangers to meet the cooling demand of rooms or other areas of a building.

As the cooling demand varies, the flow rate of the water might be adjusted according. Doing so, however, can make it difficult to control the chiller's response in providing the evaporator with appropriate cooling capacity because the chiller's controller might not be aware of the water's rate of flow. The goal is to maintain the temperature of the water as it leaves the evaporator at a desired target temperature (e.g., 35° F.). Without knowing the flow rate of the water, the chiller might overcorrect at low water flow rates or respond too sluggishly at higher flow rates.

To address this problem, a flow meter could be added to the water circuit; however, such meters can be rather expensive. Alternatively, water pressure sensors upstream and downstream of the evaporator could be used to help determine the approximate flow rate through the evaporator, but the accuracy of such a method can vary depending on the total water head and whether the physical condition of the evaporator remains constant over years of use. The design of the evaporator and the actual flow rate of the water can also affect the accuracy of measuring flow rate based on the pressure drop across the evaporator.

SUMMARY OF THE INVENTION

It is an object of the invention to provide a method for controlling a refrigerant chiller, wherein the water flows through the chiller's evaporator at a rate that is variable and is not directly known, i.e., the flow rate is not determined by sensing the water's flow rate or pressure drop.

Another object of some embodiments is to estimate the water flow rate through an evaporator based on the rate of refrigerant flowing through an expansion valve.

Another object of some embodiments is to maintain the temperature of water leaving an evaporator at a desired target outlet temperature while the water's flow rate is variable and generally unknown.

Another object of some embodiments is to estimate the estimate the cooling capacity of an evaporator based on the degree of valve opening of an expansion valve that regulates the refrigerant flow rate, a pressure differential across the expansion valve, and a change in enthalpy per unit mass of the refrigerant flowing through the evaporator.

Another object of some embodiments is to estimate cooling capacity of an evaporator without having to measure the rate at which water flows through the evaporator.

One or more of these and/or other objects of the invention are provided by a method of controlling a chiller system having variable aqueous liquid flow through an evaporator wherein flow rate is not directly known and the cooling capacity of the chiller's evaporator is estimated based the degree of valve opening of an expansion valve that regulates the refrigerant flow rate to the evaporator, a pressure differential across the expansion valve, and a change in enthalpy per unit mass of the refrigerant flowing through the evaporator.

DESCRIPTION OF THE PREFERRED EMBODIMENT

Figure 1:
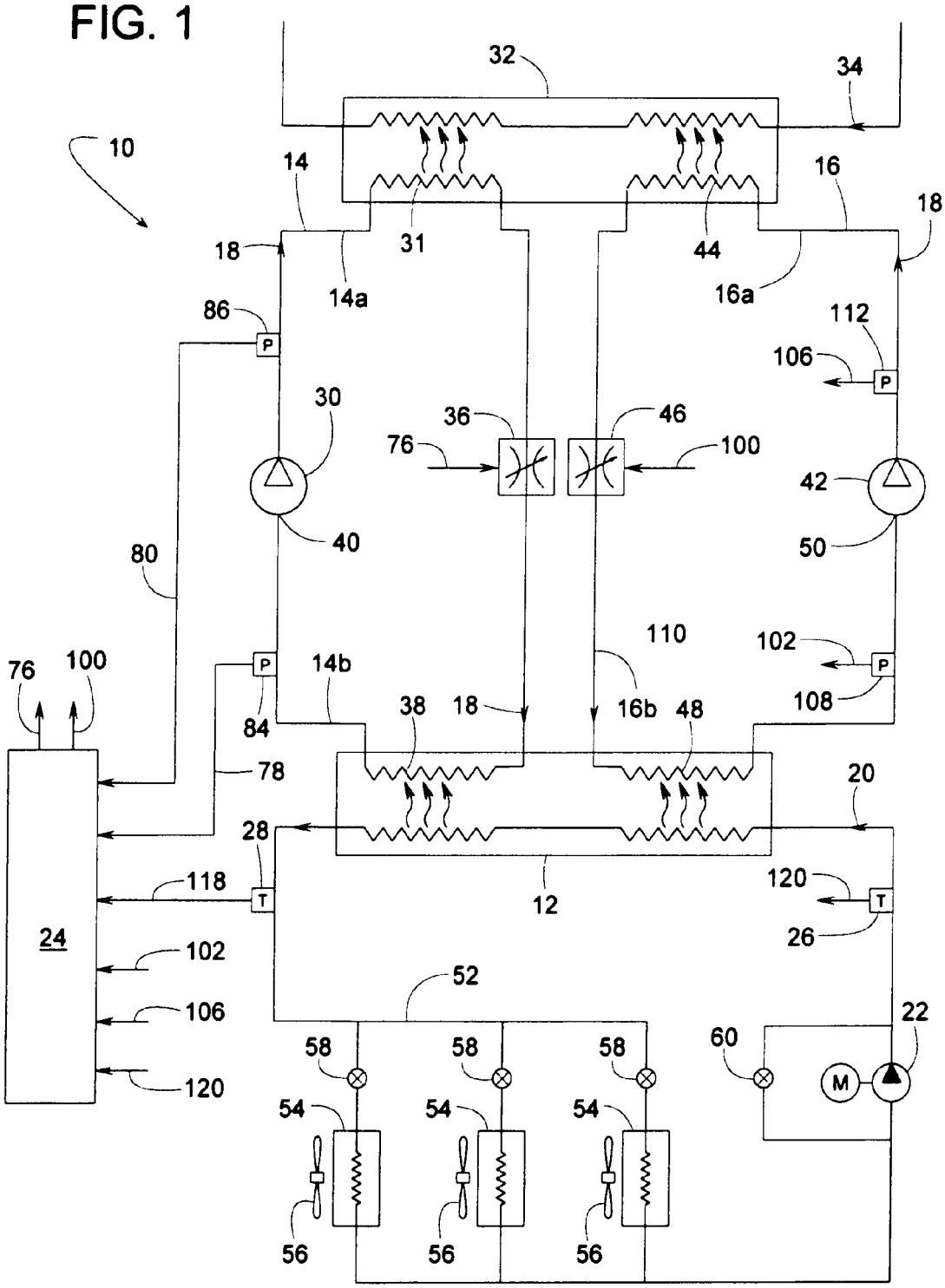
FIG. 1 is a schematic view of a chiller system.

A chiller system 10, shown in FIG. 1, includes an evaporator system 12 that is part of at least one refrigerant circuit, such as a circuit 14 and/or 16. Chiller system 10 circulates a refrigerant 18 through circuit 14 and/or 16 to cool an aqueous liquid 20 flowing through evaporator system 12. Refrigerant 18 and liquid 20 are hermetically isolated from each other. A pump 22 forces liquid 20 through evaporator system 12 and also pumps the cooled liquid 20 to wherever cooling may be needed. The term, "aqueous" refers to any liquid containing at least a trace of water. Aqueous liquid 20, for example, can be pure water or a mixture of water and glycol. Other examples of liquid 20 are certainly possible and well within the scope of the invention.

To meet a varying cooling demand, liquid 20 is pumped through evaporator 12 at various flow rates, and a controller 24 responsive to various sensors controls system 10 such that the evaporator's cooling capacity (e.g., tons) is appropriate for any given liquid flow rate. Specifically, controller 24 adjusts chiller system 10 such that the cooling capacity of evaporator system 12 is at a level where liquid 20 leaving evaporator 12 is kept at a predetermined target outlet temperature (e.g., 35° F.), regardless of the liquid's flow rate.

The relationship between the evaporator's cooling capacity and the resulting temperature of liquid 20 leaving evaporator 12 can be determined based on the capacity being substantially equal to the mass flow rate of liquid 20 through evaporator 12 times the liquid's specific heat times the liquid's decrease in temperature as liquid 20 passes through evaporator 12. Although the temperature of liquid 20 entering and leaving evaporator 12 is easy to determine using temperature sensors 26 and 28, the mass flow rate of liquid 20 can be difficult or expensive to measure directly. Thus, the present invention provides an alternate, novel method of estimating the evaporator's cooling capacity without actually having to measure the liquid's flow rate.

Instead of determining the evaporator's capacity as a function of the liquid's flow rate through evaporator 12, the capacity is determined based on the mass flow rate of the refrigerant flowing through one or more expansion valves and the refrigerant's change in enthalpy as refrigerant 18 passes through evaporator 12. The refrigerant's flow rate through an expansion valve can be determined based on the valve's degree of opening, the pressure drop across the valve, and known flow characteristics of the valve. This method will be described in more detail with reference to the dual-circuit chiller system shown in FIG. 1; however, the same basic method can also be readily applied to single-circuit refrigerant circuits and numerous other system configurations as well.

For the illustrated example, circuit 14 (also referred to as a first circuit or circuit-A) comprises a refrigerant compressor 30 that discharges relatively high pressure, high temperature vaporous refrigerant 18 into a first condenser circuit 31 within a condenser system 32. Compressor 30 can be any type of compressor including, but not limited to, a centrifugal compressor, screw compressor, scroll compressor, reciprocating compressor, etc. Condenser system 32 can be a single or duplex shell and tube heat exchanger with a cooling fluid 34 being conveyed through the tubes and refrigerant 18 passing through the shell across the tubes. As refrigerant 18 passes across the tubes, the refrigerant being in heat transfer relationship with fluid 34 condenses within the shell of condenser system 32.

Downstream of condenser 32, first circuit 14 has an expansion valve 36 (also referred to as a first expansion valve or a valve-A). The portion of circuit 14 that is downstream of compressor 30 and upstream of expansion valve 36 is referred to as a high-pressure side 14*a* of circuit 14. Expansion valve 36 provides an adjustable flow restriction that conveys refrigerant 18 from condenser circuit 31 to evaporator system 12. Upon passing through valve 36 at a regulated mass flow rate, refrigerant 18 cools by expansion and then enters a first evaporator circuit 38 of evaporator system 12. Evaporator system 12 can be a single or duplex shell and tube heat exchanger with liquid 20 being conveyed through the tubes and cooler refrigerant 18 passing through the shell across the tubes. As the relatively cool refrigerant 18 passes across the tubes, the refrigerant vaporizes upon cooling liquid 18. After vaporizing, refrigerant 18 returns to a suction inlet 40 of compressor 30 to perpetuate the cycle of first circuit 14. The portion of circuit 14 that is downstream of expansion valve 36 and upstream of compressor 30 is referred to as a low-pressure side 14*b* of circuit 14.

Likewise, second circuit 16 (also referred to as a second circuit or circuit-A) comprises a refrigerant compressor 42 (e.g., one similar to compressor 30) that discharges relatively high pressure, high temperature vaporous refrigerant 18 into a second condenser circuit 44 within condenser system 32. For this particular embodiment of the invention, circuits 14 and 16 each have their own separate charge of refrigerant, and the two charges do not mix with each other. With condenser system 32 being a shell and tube heat exchanger, as refrigerant 18 passes across the tubes and through the shell, the refrigerant is cooled by fluid 34 and condenses within the shell of condenser system 32.

Downstream of condenser circuit 44, second circuit 16 has an expansion valve 46 (also referred to as a second expansion valve or a valve-B). The portion of circuit 16 that is downstream of compressor 42 and upstream of expansion valve 46 is referred to as a high-pressure side 16*a* of circuit 16. Expansion valve 46 provides an adjustable flow restriction that conveys refrigerant 18 from second condenser circuit 44 to evaporator system 12. Upon passing through valve 46 at a regulated mass flow rate, refrigerant 18 cools by expansion and then enters a second evaporator circuit 48 of evaporator system 12. With evaporator system 12 being a shell and tube heat exchanger, the relatively cool refrigerant 18 passing across the tubes vaporizes upon cooling liquid 20. After vaporizing, refrigerant 18 returns to a suction inlet 50 of compressor 42 to perpetuate the cycle of second circuit 16. The portion of circuit 16 that is downstream of expansion valve 46 and upstream of compressor 42 is referred to as a low-pressure side 16*b* of circuit 16.

Although liquid 20 chilled within evaporator system 12 can be used for various purposes, system 10 is particularly suited for conveying chilled liquid 20 through a liquid circuit 52 that includes a network of heat exchangers 54. It should be appreciated by those of ordinary skill in the art, however, that liquid circuit 52 is for sake of example and that countless other liquid circuit configurations are certainly possible and well within the scope of the invention. Nonetheless, in this example, heat exchangers 54 can each be associated with a fan 56 for supplying cool supply air to various comfort zones, such as rooms or other designated areas of a building. Control valves 58 upstream or downstream of heat exchangers 54 regulate the amount of cool liquid flowing to each heat exchanger 54, thus valves 58 control the amount of cooling that each heat exchanger 54 provides.

As the total cooling demand applied to heat exchanger's 54 varies, the liquid mass flow rate through evaporator 12 is adjusted accordingly. This can be done by driving pump 22 with a variable speed motor, adding a variable bypass valve 60 in parallel with pump 22, using a variable volume pump, or using various other adjustable flow means well known to those of ordinary skill in the art.

As liquid circuit 52 applies a varying load to refrigerant system 10, controller 24 adjusts the operation of chiller system 10 such that evaporator system 12 has a cooling capacity that maintains the liquid leaving evaporator 12 at a predetermined target outlet temperature. Depending on the specific chiller system, the chiller's operation might be adjusted by various means including, but not limited to, adjusting the speed of one or more compressors, selectively operating and de-energizing multiple compressors, adjusting a centrifugal compressor's inlet guide vanes, adjusting a screw compressor's slide valve, adjusting the temperature or flow rate of a fluid cooling the refrigerant in a condenser, adjusting the degree of opening of one or more expansion valves, and/or various combinations thereof.

Figure 2:
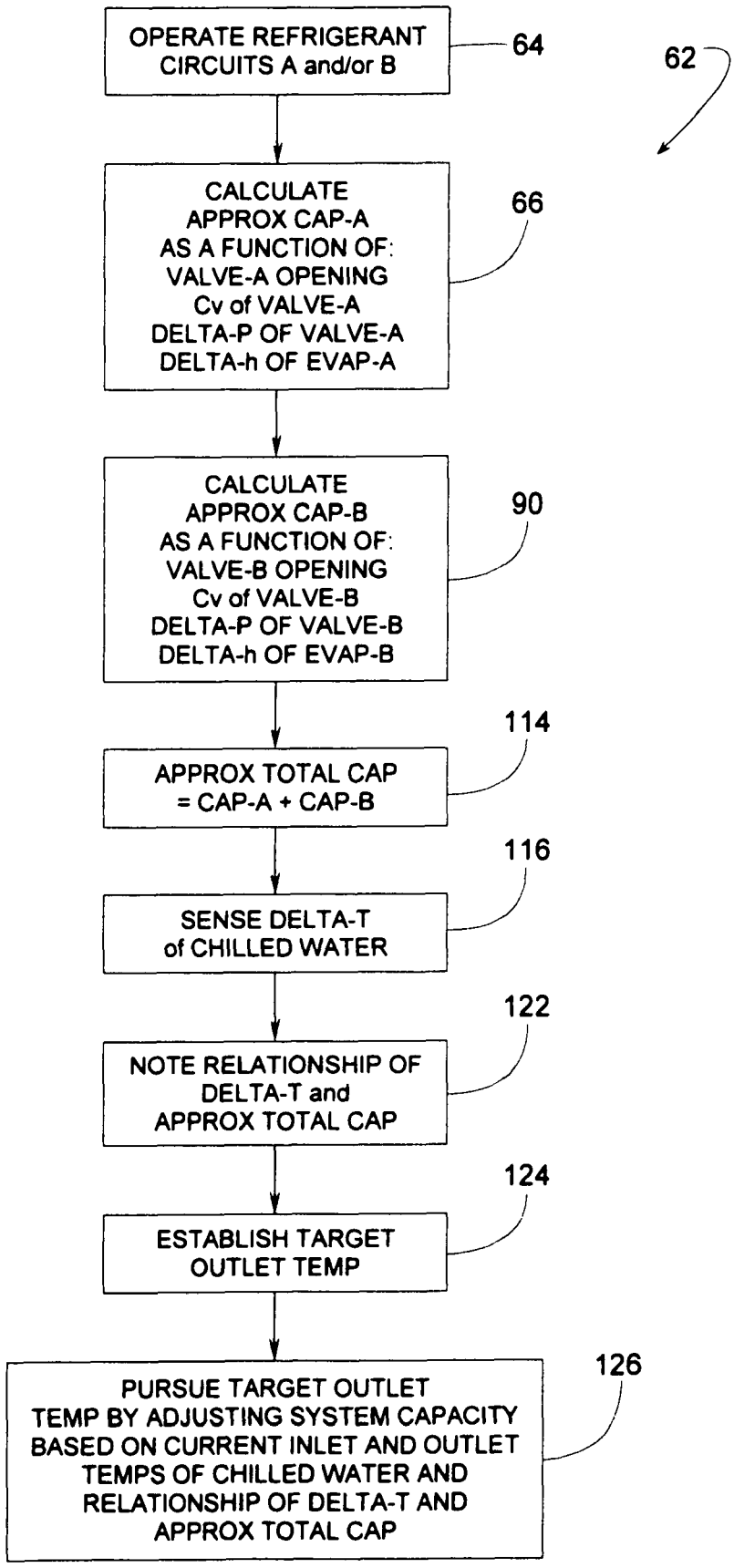
FIG. 2 is a block diagram of an algorithm applied to the chiller of FIG. 1.

For the illustrated example, controller 24 operates according to an algorithm 62 of FIG. 2. In control block 64, controller 24 energizes compressors 30 and/or 42 to activate circuits 14 and/or 16 respectively.

In block 66, controller 24 calculates a first capacity value (e.g., tons) representative of an estimate of the first capacity at which circuit 14 provides cooling in evaporator system 12. The first capacity value is calculated as a function of a degree of valve opening of first expansion valve 36, a pressure differential of the refrigerant between high pressure side 14*a* and low pressure side 14*b*, and a change in enthalpy per unit mass of refrigerant 18 flowing through evaporator circuit 38 of evaporator system 12.

For accuracy, the pressure differential between high side 14*a* and low side 14*b* preferably is sensed right at expansion valve 36; however, the pressure differential can be sensed at other locations. Sensing the pressure differential is depicted by pressure sensors 84 and 86 providing controller 24 with pressure feedback signals 78 and 80. The sensing of the pressure differential is schematically illustrated, and the actual sensing of these pressures could be achieved by a single differential pressure sensor that conveys a single differential pressure signal to controller 24.

For sake of example, expansion valve 36 can be a Sporlan Y1187-1-SEH1-175 valve that is stepper-motor driven. Thus, the degree of opening of expansion valve 36 is known or can at least be determined by controller 24 because controller 24 is what provided an output signal 76 that commanded expansion valve 36 to open a certain degree in the first place. Alternatively, an encoder or some other suitable position feedback device could be added to expansion valve 36, and such a device could provide controller 24 with a feedback signal that indicates the valve's degree of opening.

The refrigerant's change in enthalpy per unit mass as refrigerant 18 passes through evaporator 12 can be approximated and considered generally constant. For greater accuracy, however, the approximate change in enthalpy can be calculated based on various thermodynamic values such as, for example, the saturated vapor pressure in evaporator circuit 38, the saturated liquid temperature of condenser circuit 31, the temperature of fluid 32 entering condenser circuit 31, and various combinations thereof. Converting pressure and/or temperature values to enthalpy can be done with reference to commonly known thermodynamic equations or lookup tables stored in controller 24.

Controller 24 calculates the refrigerant's mass flow rate based on the known degree of opening of expansion valve 36 (output signal 76), the sensed pressure differential across valve 36 (feedback signals 80 and 84), the approximate known density of liquid refrigerant 18, and the known flow characteristics of valve 36 (i.e., the valve's rated or empirically derived flow coefficient Cv).

In block 90, controller 24 calculates a second capacity value (e.g., tons) representative of an estimate of the second capacity at which circuit 16 provides cooling in evaporator system 12. The second capacity value is calculated as a function of a degree of valve opening of second expansion valve 46, a pressure differential of the refrigerant between high pressure side 16*a* and low pressure side 16*b*, and a change in enthalpy per unit mass of refrigerant 18 flowing through evaporator circuit 48 of evaporator system 12.

Again, for accuracy, the pressure differential between high side 16*a* and low side 16*b* preferably is sensed right at expansion valve 46; however, the pressure differential can be sensed at other locations. Sensing the pressure differential is depicted by pressure sensors 108 and 106 providing controller 24 with pressure feedback signals 102 and 106. The sensing of the pressure differential is schematically illustrated, and the actual sensing of these pressures could be achieved by a single differential pressure sensor that conveys a single differential pressure signal to controller 24.

Although expansion valves 36 and 46 do not necessarily have to be the same, expansion valve 46 can be another Sporlan Y1187-1-SEH1-175 valve. Thus, the degree of opening of expansion valve 46 is also known or can at least be determined by controller 24 because controller 24 is what provided an output signal 100 that commanded expansion valve 46 to open a certain degree in the first place. Alternatively, an encoder or some other suitable position feedback device could be added to expansion valve 46, and such a device could provide controller 24 with a feedback signal that indicates the valve's degree of opening.

The refrigerant's change in enthalpy per unit mass as refrigerant 18 passes through evaporator 12 can be approximated and considered generally constant. For greater accuracy, however, the approximate change in enthalpy can be calculated based on various thermodynamic values such as, for example, the saturated vapor pressure in evaporator circuit 48, the saturated liquid temperature of condenser circuit 44, the temperature of fluid 32 entering condenser circuit 44, and various combinations thereof. Converting pressure and/or temperature values to enthalpy can be done with reference to commonly known thermodynamic equations or lookup tables stored in controller 24.

Controller 24 calculates the refrigerant's mass flow rate based on the known degree of opening of expansion valve 46 (output signal 100), the sensed pressure differential across valve 46 (feedback signals 106 and 102), the approximate known density of liquid refrigerant 18, and the known flow characteristics of valve 46 (i.e., the valve's rated or empirically derived flow coefficient Cv).

In block 114, controller 24 calculates a total capacity value, which in this example is the sum of the two capacity values determined in blocks 66 and 90. If a refrigerant system were to have more than two refrigerant circuits, then the total capacity value would be the sum of all the individual capacity values of those circuits. If a refrigerant system had only one active refrigerant circuit, then the total capacity value would equal the capacity value of that one circuit. For some chiller systems, the calculated capacity values can be adjusted by an empirically derived adjustment factor so that the calculated capacity value more closely reflects the actual cooling capacity of the chiller's evaporator.

In block 116, controller 24 receives temperature feedback signals 118 and 120 from temperature sensors 28 and 26 that sense the liquid's temperature as liquid 20 enters and leaves evaporator 12. Based on signals 118 and 120, controller 24 determines the liquid's drop in temperature as liquid 20 passes through evaporator 12.

In block 122, controller 24 notes the relationship between the liquid's temperature differential (block 116) and the computed cooling capacity value of evaporator 12 (block 114).

In block 124, a predetermined target outlet temperature of liquid 20 leaving evaporator 12 is established.

Upon knowing the relationship of the liquid's change in temperature and the cooling capacity of evaporator 12, in block 126 controller 24 adjusts the operation of chiller system 10 to achieve an evaporator cooling capacity that drives the liquid's leaving temperature (signal 118) to the predetermined target temperature. Depending on the design of the chiller, adjusting the chiller's operation can involve adjusting the operation of compressor 30 and/or 42, adjusting the position of inlet guide vanes, adjusting a screw compressor's slide valve, and/or adjusting the opening of expansion valve 36 and/or 46.

Although the invention is described with respect to a preferred embodiment, modifications thereto will be apparent to those of ordinary skill in the art.

The scope of the invention, therefore, is to be determined by reference to the following claims:

1. A method of controlling a chiller system, the method comprising: operating the chiller system at a first capacity by circulating a refrigerant at a refrigerant flow rate through an evaporator system, wherein the refrigerant flow rate is adjustable;

chilling an aqueous liquid by pumping the aqueous liquid at a variable liquid flow rate through the evaporator system such that the aqueous liquid enters the evaporator system at an inlet temperature and leaves the evaporator system at an outlet temperature, wherein the inlet temperature and the outlet temperature may vary;

without actually measuring the variable liquid flow rate, calculating a first capacity value representative of an estimate of the first capacity;

establishing a target outlet temperature of the aqueous liquid leaving the evaporator system;

measuring the outlet temperature of the aqueous liquid; and adjusting the refrigerant flow rate based on the first capacity value and a temperature difference between the outlet temperature and the target outlet temperature.

2. The method of claim 1, wherein the first capacity value is calculated as a function of a degree of valve opening of an expansion valve that regulates the refrigerant flow rate, a pressure differential across the expansion valve, and a change in enthalpy per unit mass of the refrigerant flowing through the evaporator system.

3. The method of claim 1, wherein the first capacity value is calculated substantially independently of any direct measurement of an actual aqueous liquid pressure drop across the evaporator system.

4. The method of claim 1, wherein the aqueous liquid enters the evaporator system at an inlet pressure and leaves the evaporator system at an outlet pressure, and the outlet pressure is appreciably greater than a difference between the inlet pressure and the outlet pressure.

5. The method of claim 1, wherein the chiller system comprises a first refrigerant circuit and a second refrigerant circuit that both contribute to the refrigerant flow rate through the evaporator system, the first refrigerant circuit includes a first charge of the refrigerant having a first flow rate regulated by a first expansion valve, and the second refrigerant circuit includes a second charge of the refrigerant having a second flow rate regulated by a second expansion valve, the first charge and the second charge are physically isolated from each other, both the first charge and the second charge pass through the evaporator system to chill the aqueous liquid.

6. The method of claim 1, further comprising circulating the aqueous liquid between the evaporator system and a network of heat exchangers.

7. A method of controlling a chiller system, the method comprising:

compressing a refrigerant;

forcing the refrigerant through a first expansion valve, whereby the steps of compressing and forcing provide the chiller system with a high pressure side and a low pressure side;

operating the chiller system at a first capacity by circulating the refrigerant at a cumulative refrigerant flow rate through an evaporator system, wherein the first expansion valve can regulate the cumulative refrigerant flow rate;

chilling an aqueous liquid by pumping the aqueous liquid at a variable liquid flow rate through the evaporator system in heat exchange with the refrigerant such that the aqueous liquid enters the evaporator system at an inlet temperature and leaves the evaporator system at an outlet temperature, wherein the inlet temperature and the outlet temperature may vary;

calculating a first capacity value representative of an estimate of the first capacity, wherein the first capacity value is calculated as a function of a degree of valve opening of the first expansion valve, a pressure differential of the refrigerant between the high pressure side and the low pressure side, and a change in enthalpy per unit mass of the refrigerant flowing through the evaporator system;

establishing a target outlet temperature of the aqueous liquid leaving the evaporator system;

measuring the outlet temperature of the aqueous liquid; and adjusting the cumulative refrigerant flow rate based on:the first capacity value and a temperature difference between the outlet temperature and the target outlet temperature.

8. The method of claim 7, wherein the first capacity value is calculated without actually measuring the variable liquid flow rate.

9. The method of claim 7, wherein the first capacity value is calculated substantially independently of any direct measurement of an actual aqueous liquid pressure drop across the evaporator system.

10. The method of claim 7, wherein the aqueous liquid enters the evaporator system at an inlet pressure and leaves the evaporator system at an outlet pressure, and the outlet pressure is appreciably greater than a difference between the inlet pressure and the outlet pressure.

11. The method of claim 7, wherein the pressure differential of the refrigerant is substantially equal to a pressure drop across the first expansion valve.

12. The method of claim 7, wherein the chiller system comprises a first refrigerant circuit and a second refrigerant circuit that both contribute to the cumulative refrigerant flow rate through the evaporator system, the first refrigerant circuit includes the first expansion valve and a first charge of the refrigerant, and the second refrigerant circuit includes a second expansion valve and a second charge of the refrigerant, the first charge and the second charge are physically isolated from each other, both the first charge and the second charge pass through the evaporator system to chill the aqueous liquid.

13. The method of claim 12, further comprising calculating a cumulative capacity value substantially equal to the first capacity value plus a second capacity value, wherein the second capacity value is calculated based on an extent of valve opening of the second expansion valve, a second pressure differential of the refrigerant between a second high pressure side and a second low pressure side of the second refrigerant circuit, and an increase in enthalpy per unit mass of the refrigerant flowing through the evaporator system via the second refrigerant circuit.

14. The method of claim 13, further comprising adjusting the cumulative refrigerant flow rate based on the first capacity value, the second capacity value, and the temperature difference between the outlet temperature and the target outlet temperature of the aqueous liquid.

15. The method of claim 7, further comprising circulating the aqueous liquid between the evaporator system and a network of heat exchangers.

16. A method of controlling a chiller system that includes a first refrigerant circuit having a first charge of refrigerant and a second refrigerant circuit having a second charge of refrigerant, the method comprising:

operating the chiller system at a first capacity by circulating the first charge of refrigerant at a first refrigerant flow rate and the second charge of refrigerant at a second refrigerant flow rate through an evaporator system, wherein the first charge of refrigerant is physically isolated from the second charge of refrigerant;

chilling an aqueous liquid by pumping the aqueous liquid at a variable liquid flow rate through the evaporator system such that the aqueous liquid enters the evaporator at an inlet temperature and leaves the evaporator at an outlet temperature, wherein the inlet temperature and the outlet temperature may vary;

calculating a capacity value representative of an estimate of the first capacity, wherein the capacity value is calculated as a function of:

a) a degree of valve opening of a first expansion valve that adjusts the first refrigerant flow rate, b) a degree of valve opening of a second expansion valve that adjusts the second refrigerant flow rate, c) a pressure differential across the first expansion valve, d) a pressure differential across the second expansion valve, e) a change in enthalpy per unit mass of the first charge of refrigerant flowing through the evaporator system; and f) a change in enthalpy per unit mass of the second charge of refrigerant flowing through the evaporator system;

establishing a target outlet temperature of the aqueous liquid leaving the evaporator system;

measuring the outlet temperature of the aqueous liquid; and adjusting at least one of the first refrigerant flow rate and the second refrigerant flow rate based on the capacity value and a temperature difference between the outlet temperature and the target outlet temperature.

17. The method of claim 16, wherein the capacity value is calculated without actually measuring the variable liquid flow rate.

18. The method of claim 16, wherein the capacity value is calculated substantially independently of any direct measurement of an actual aqueous liquid pressure drop across the evaporator system.

19. The method of claim 16, wherein the aqueous liquid enters the evaporator system at an inlet pressure and leaves the evaporator system at an outlet pressure, and the outlet pressure is appreciably greater than a difference between the inlet pressure and the outlet pressure.

20. The method of claim 16, further comprising circulating the aqueous liquid between the evaporator system and a network of heat exchangers.

* * * * *